US007997310B2

(12) United States Patent
Balolia

(10) Patent No.: US 7,997,310 B2
(45) Date of Patent: Aug. 16, 2011

(54) COMBINATION PLANER/MOULDER WITH ADJUSTABLE VERTICAL SUPPORT AND METHOD OF ADJUSTMENT

(75) Inventor: Shiraz Balolia, Bellingham, WA (US)

(73) Assignee: Woodstock International, Inc., Bellingham, WA (US)

( * ) Notice: Subject to any disclaimer, the term of this patent is extended or adjusted under 35 U.S.C. 154(b) by 166 days.

(21) Appl. No.: 12/333,984

(22) Filed: Dec. 12, 2008

(65) Prior Publication Data

US 2009/0151818 A1 Jun. 18, 2009

Related U.S. Application Data

(60) Provisional application No. 61/014,652, filed on Dec. 18, 2007.

(51) Int. Cl.
*B27C 1/00* (2006.01)

(52) U.S. Cl. ..... 144/114.1; 144/117.1; 144/130; 144/373; 409/206; 409/210

(58) Field of Classification Search ..... 144/114.1, 144/117.1, 129, 130, 373; 409/206, 210, 409/212, 214, 218, 204
See application file for complete search history.

(56) References Cited

U.S. PATENT DOCUMENTS

| | | | | |
|---|---|---|---|---|
| 877,422 | A * | 1/1908 | Herman | 409/206 |
| 927,776 | A * | 7/1909 | DeLeeuw | 409/206 |
| 971,885 | A * | 10/1910 | Grohmann | 409/206 |
| 5,042,542 | A * | 8/1991 | Purviance | 144/135.2 |
| 5,662,441 | A * | 9/1997 | Wang | 409/185 |

* cited by examiner

*Primary Examiner* — Shelley Self
(74) *Attorney, Agent, or Firm* — Husch Blackwell LLP

(57) ABSTRACT

A combination planer/moulder having means to raise, lower and lock a cutting member at a desired position is provided. The device includes a platform onto which a table for holding materials and an adjustment system are attached. The adjustment system includes at least one column having a rectilinear wall. A cutterhead is provided, having cooperative openings and a locking means, such that it may move along the at least one column of the adjustment system and locked in place. The rectilinear wall of the column cooperates with a similarly shaped opening in the cutterhead, such that by pressing the rectilinear shaped side of the opening against the rectilinear wall of the column the cutterhead may be fixed in desirable positions to permit work on materials and released for adjustment. The device includes a window such that the placement of the cutting knives on the materials can be viewed and debris can be seen and removed therefrom.

17 Claims, 9 Drawing Sheets

COMBINATION PLANER/MOULDER WITH ADJUSTABLE VERTICAL SUPPORT AND METHOD OF ADJUSTMENT

FIELD OF THE INVENTION

The present invention concerns a combination machine for woodworking. A combination machine is one that associates the functions of two or more separate machines into a single unit; combining such functions as carving and smoothing or others. More particularly the present invention concerns a combined planer and moulder having an improved system of moving and affixing the cutterhead of the device relative to the material to be worked to aid in preparing wood worked pieces.

BACKGROUND OF THE INVENTION

Existing planers and moulders on the market use round columns to support and guide the cutterhead of the device as it is moved up or down relative to the position of the material to be planed and/or moulded. Typically four columns are used such that the columns are placed on each of the four corners of the cutting plane of the device. Some planer moulders of the prior art include: Grizzly Industrial, Inc. of Bellingham Wash. models G1017 12" Planer, G1021 15" Planer, G1033 20" Planer, G3616 Milling Machine, G9732 Metal Cutting Lathe: Woodstock International Inc. of Bellingham, Wash. model W1739 Planer/Moulder; and Williams & Hussey Machine Co., Inc. of Milford, N.H. Planer/Moulder. Typically these machines comprise a platform for placement of the material to be worked serviced by a cutterhead that can be adjusted relative to these materials. The cutterhead typically rides along four cylindrical columns, placed at the perimeter of the work area, with various rods and screws, positioned generally perpendicular to the columns, used to lock the cutterhead in place. The cutting knives, within the cutterhead, can be brought and held against the material to be worked. The cylindrical columns typically are paired with cooperative mating surfaces on stops associated with the rods and screws such that when pressure is applied by the stops on the columns, the cutterhead is held at the appropriate position relative to the work table and can subsequently be adjusted up and down relative to the table as needed.

The use of rounded surfaces such as the columns, rods, screws and stops used in the above noted prior art generally provide inadequate holding power for a cutterhead system. Further, with time and usage, such systems are known to wear, causing slippage of the cutterhead relative to the table surfaces. It is known that the mating surfaces of the round columns and cooperative support casting or table eventually wear away due to the friction caused by continually adjusting and readjusting their relative positions as required by the machine's use. This causes looseness or "play" to develop in the system for which, as a result of the configurations, there is no ultimate adjustment; the machines must be overhauled with replacement of many parts. This "play" affects the locking ability, accuracy and safe operation of the machine. Further, it is costly to remedy this as replacement of the round columns and upper support casting is usually eventually necessary. Such a procedure requires replacement parts and technician time and is costly and time consuming, keeping a working machine away from work.

Generally in the past, woodworking, including planning, molding and shaping for which such devices have been used has not been exacting as the locking mechanisms used with the round column system of support are by their nature only able to apply pressure in a very small area on the columns. In some wood working machines, the clamping device and column have very little area of contact. Consequently, the actual clamping force available to secure the cutterhead assembly is small and often inadequate to the task; allowing slippage of the cutterhead assembly and consequently continual re-tightening. Such continual adjustments take away from actual work time as well. As machines wear this effect becomes progressively worse and rather than replace parts or get new machines, lesser quality work has become acceptable up to the point of the potential failure of the machines of the past. However, it is desirable, particularly with costly materials to be able to provide shaped materials of high quality, design and fit.

In some large scale metal shaping machines, due to the extreme weights developed by the working elements of those devices, columns having a rectilinear wall and a locking mechanism that apply pressure to the column vertical surface have been developed. However, such mechanisms have not been used in woodworking machines because of the significant differences in these devices, including the added weight in a metal working machine, the costs of redesigning accepted machinery and the generally diametric differences in the developments and evolution of wood and metal working machines.

Further, wood working machines of the past have also suffered in that once the cutterhead is put into position and locked into place and the subject wood is fed into the device, the user can not see the results of the work until the material emerges from the machine. If the machine is incorrectly set, or if the adjustments of the height and position have been compromised as a result of slippage, as described above, or if material chips or waste products are interdicting the cutting knives, or for other reasons, a poorly shaped piece of moulding would emerge and would comprise a lost or wasted piece of material. With the increased costs of materials such waste is unconscionable and can be the difference in a profit or loss in a project. Further, the wasting of natural resources has become disfavored, especially as conservation is now sought in projects and is popular. It would be desirable to have a means to visually check the settings of device and check if the knives or other cutting members are hindered, prior to wasting valuable materials.

SUMMARY OF THE INVENTION

In accordance with the present invention a wood working device is provided. The device, a planer/moulder for such uses as creating moldings used in construction, includes a table for the placement of the material to be shaped and an adjustment system for adjusting the cutterhead of the device relative to the table, and materials, to be worked. Materials, such as wood, are placed on a table or platform and the cutterhead, having knives therein, is adjusted to a desired position proximate to the materials. Locking means are provided to secure the cutterhead at the desired position so that work on the materials can be completed accurately. In preferred embodiments of the present invention, the adjustment system includes at least one column, having a dovetail-shaped cross-section acting as a rail, or way, with rectilinear walls onto which the cutterhead can be raised and lowered. By using a rail having a dovetail shaped cross-section with a rectilinear wall, when the cutterhead is placed at an elevation and pressure is placed against the wall effectively locking the cutterhead height to the column, the cutterhead remains in a material shaping position until moved, or unlocked manually.

In embodiments of the present invention the casting table, on which the cutterhead is attached, includes openings having a dovetail shaped cross-section, for cooperative engagement with a rectilinear wall of the dovetail shaped cross-section of the columns. It will be understood that the dovetail shaped cross sections are preferred as they tend to prevent the relative lateral movements of the column and cutterhead. However, it will be understood by persons having ordinary skill in the art that other cross-sectional shapes having a rectilinear wall can be used without departing from the novel scope of the present invention.

Further, in some embodiments, the locking means of the present invention includes an enlarged opening in the casting table for the fitment of a gib. A gib is placed within the opening such that the locking means can press the gib against the rectilinear wall of the column; in this way the gib adds surfaces to accept the wear associated with such locking means. The gib, as it wears, can be easily replaced to keep the locking means of the device working well such that the placement of the cutterhead is maintained through compression of the gib by the locking means against the dovetail-shaped columns until released.

In a preferred embodiment, the elevation system includes two dovetail shaped rails, so as to provide a more stable platform on which the work of planning, moulding or other processes may proceed. Further, in some embodiments the gib is wedge shaped so as to provide a positive lock of the cutterhead to the rails when the gib and column are compressed together by the lock.

It will be understood that the device of the present invention provides a method of accurately planing or moulding materials. The method includes the steps of providing a table, a stand and a cutterhead, the cutterhead configured to either plane or mould materials and providing an adjustment system having at least one column attached to the stand, the at least one column having at least one rectilinear wall that acts as a rail onto which the cutterhead can be raised and lowered relative to the table. As described above, a locking means is also provided and by engaging the locking means the cutterhead is pressed against the column fixing the cutterhead at a desired elevation on the column. The desired location, as understood by persons having skill in the art, is to place the cutterhead in planing or moulding contact with the material to be planed or moulded such that engaging the cutterhead causes accurate planing or moulding of the material. As noted above, in a preferred embodiment of the method of using the device, a gib is placed in the device in association with the cutterhead such that when the locking means is engaged the gib is pressed against a rectilinear wall of the column, thereby holding the device in place for planing and moulding. The locking means includes a rod and threaded knob, the rod and knob being joined together, the knob being in threaded engagement with the cutterhead and the rod being in contact with the gib, at the distal end of the rod, such that when the knob is threaded into the cutterhead, the rod presses the gib against the column.

Advantageously, the device of the present invention further includes a transparent window, preferably made of plastic materials such as Plexiglas®, such that the user may place the cutterhead in the desired position, to provide the desired shaping, while being able to view the materials and/or the cutterhead. It has been determined that hand-eye coordination in, moulding operations provides the best results. Further, the window permits the user to view and then clear any chaff from the cutterhead prior to working.

A more detailed explanation of the invention is provided in the following description and claims and is illustrated in the accompanying drawings.

BRIEF DESCRIPTION OF THE DRAWINGS

FIG. 1*a* is a plan view of the device of FIG. 11.

DETAILED DESCRIPTION OF THE ILLUSTRATIVE EMBODIMENT

Figure 1:
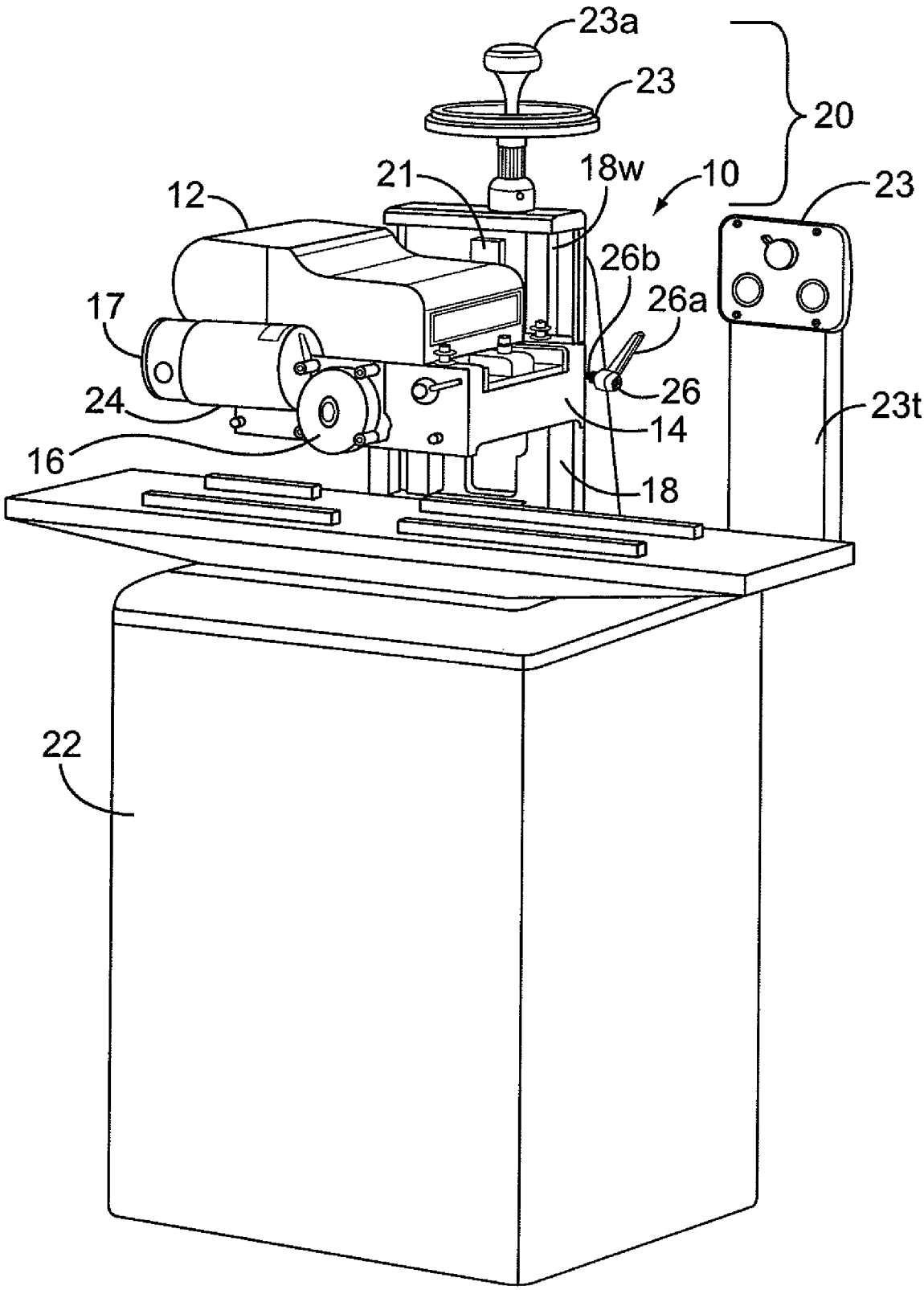
FIG. 1 partial perspective view of a device configured in accordance with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

Figure 1A:
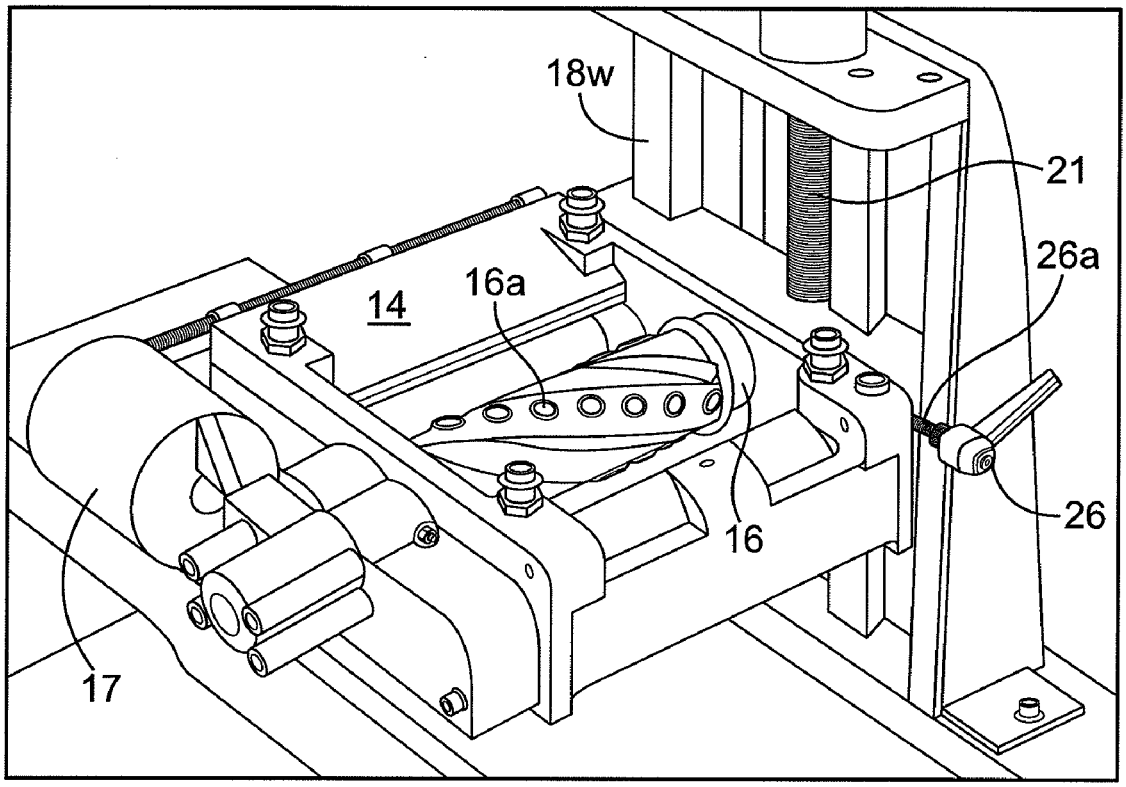
FIG. 1*a* is a perspective view of the device of FIG. 1 showing the interior of the device and the support means therefore.

Referring now to the drawings, FIG. 1 shows a planer/moulder device of the present invention. FIG. 1 shows a planer/moulder device 10, the upper assembly 12, the cutterhead casting 14, cutterhead 16, dovetail wall 18, dovetail ways 18*w*, support structure 20, the device cabinet 22 and a viewing window 24. Dovetail ways 18*w* comprise one example of a column. It will be understood that within cabinet 22, a motor, drive belt and pulley are included so as to drive the cutting knives 16*a* (FIG. 1*a*) within cutterhead casting 14; on off and speed controls 23 are provided on a conveniently located control tower 23*t*. A feeder motor 17 is attached to cutterhead casting 14 and is used to drive materials through the cutterhead casting 14 so that they can be worked. A locking means 26, comprising a rod 26*a* and knob 26*b*, and gib 28 are provided for use in locking the cutterhead casting 14 in position relative to the support structure 20. The support structure 20 includes a drive screw 21 used to drive cutterhead casting 14 up and down relative to the materials to be cut. It will be understood that cutterhead casting 14 is connected to a corresponding drive gear (not shown) that is acted upon by drive screw 21. In the illustrative embodiments a drive wheel 23, having a drive knob 23*a* is shown as the driving means (allowing up and down movement of the cutterhead casting upon rotation of wheel 23 and drive screw 21); however, it will be understood that any manner of motive force, that can rotate drive screw 21 can be utilized without departing from the novel scope of the present invention. Further, other means of moving cutterhead casting 14 upwards and downwards can be used as well.

Figure 2:
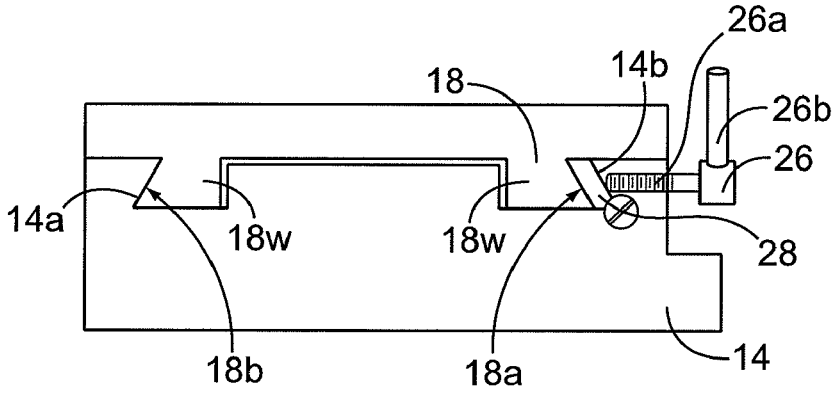
FIG. 2 is a plan view of a dovetail assembly made in accordance with the teachings of the present invention
Figure 8:
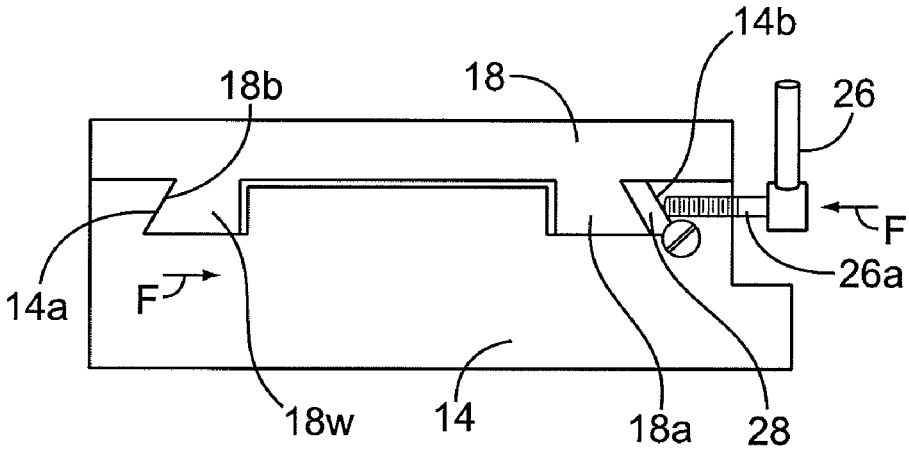
FIG. 8 is a plan view of the dovetail assembly of FIG. 2 in a locked configuration.
Figure 9:
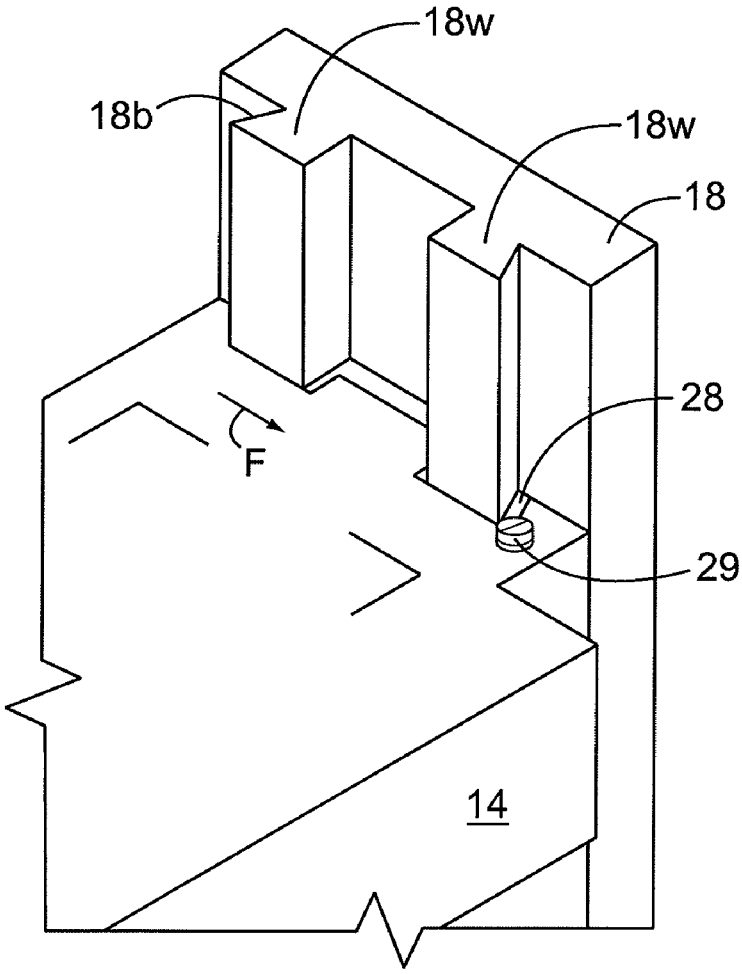
FIG. 9 is a perspective view of the device of FIG. 8.

As more clearly shown in FIG. 2, the cutterhead casting 14 is shown in relation to the dovetail ways 18*w*; gib 28 is shown in place between a rectilinear wall 18*a* of ways 18*w* and correspondingly shaped wall of cutterhead casting 14. Sufficient space for a gib 28 is included and means such that a locking means knob 26*b* and locking rod 26*a* penetrate casting 14 through to gib 28 to apply pressure thereon. Pressure by locking means 26 and gib 28 cause cutterhead casting 14 and dovetail ways 18*w* to press against each other (See FIG. 8), forming a friction locking between casting 14 and dovetail ways 18*w* at casting surface 14*a* and way surface 18*b*. As seen in FIG. 8, pressure by locking means 26 causes a concomitant force F to be directed as shown. Further friction locking occurs simultaneously at the gib 28 surfaces that are touched by casting wall 14*b* and dovetail wall 18. Force F provides a similar force as provided by locking means 26, to the other column of the device, providing a duplication of the fixing force without requiring a second locking means thereon. It will be understood, however, that a second, similar locking means, can be applied on the other side of the device by persons having ordinary skill in the art, without departing from the novel scope of the present invention. Such a second locking means, while not providing additional locking force, would allow the user to lock the device from either side of the machine and thereby prove some convenience to the user. Advantageously, gib 28 is replaceable as it wears, such that a simple replacement of gib 28 can renew the contact surfaces most responsible for the friction locking in the present invention. A perspective view of the present embodiment is shown in FIG. 9.

Figure 3:
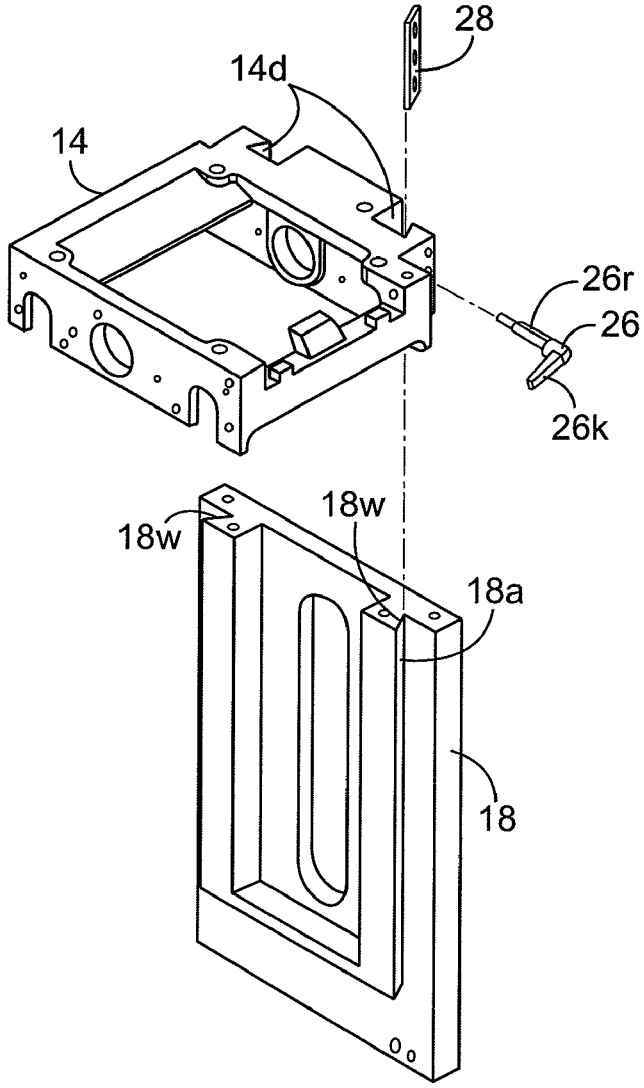
FIG. 3 is an exploded perspective view of a cutterhead casting, a support casting, gib and lock knob for use in a device made in accordance with the teachings of the present invention.

As shown in FIG. 3, casting 14, on which cutterhead 16 and cutterhead casting 14 rests, includes openings 14*o* that are sized and shaped to cooperate with dovetail ways 18*w* on wall 18. Sufficient space is provided between casting 14 and wall 18 such that when unlocked casting 14 can move freely along wall 18. Gib 28 and locking means 26, when in a locked position cause the casting 14 and wall 18 to be pushed together to form a friction fit, as described above, that holds casting 14, and cutterhead 16, in a desired location on device 10. This is the improvement in the locking means of the present invention when compared to the prior art (as shown in FIGS. 4 through 6*b*).

Figure 4:
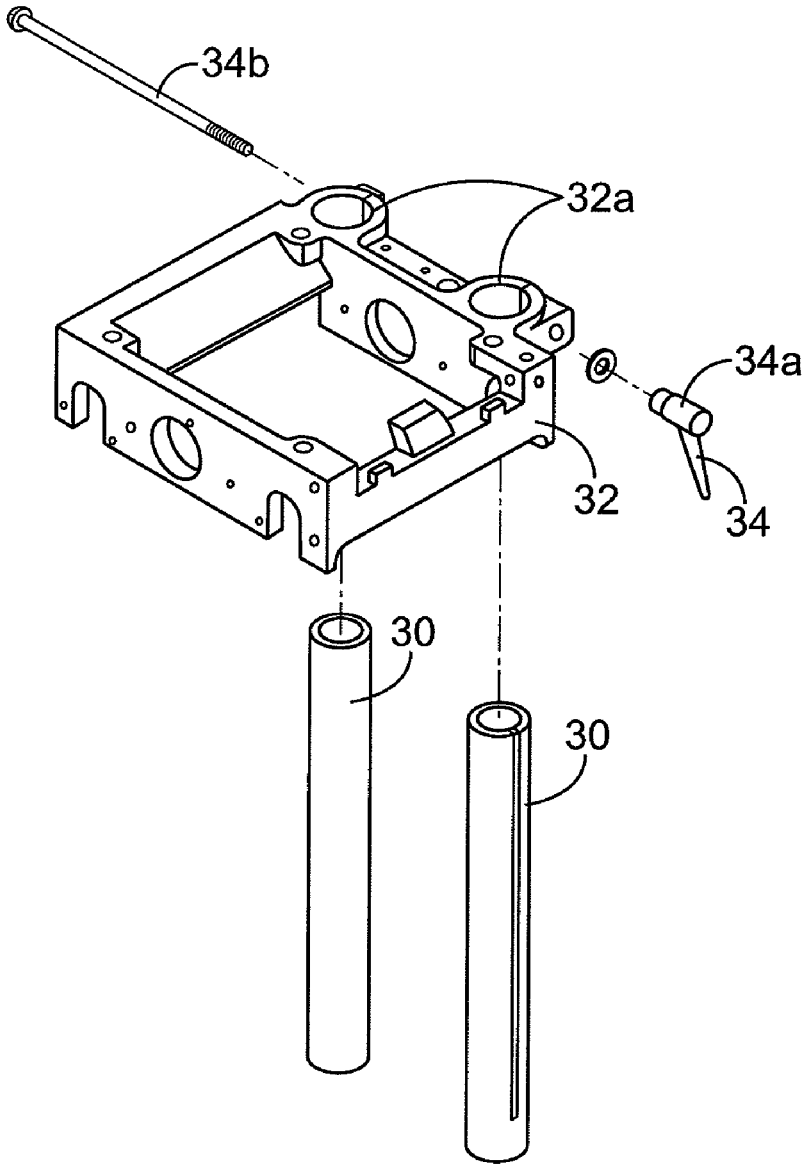
PRIOR ART FIG. 4
FIG. 4 is an exploded perspective view of the cutterhead casting, round columns and locking mechanism for a moulder planer of the prior art.
Figure 5:
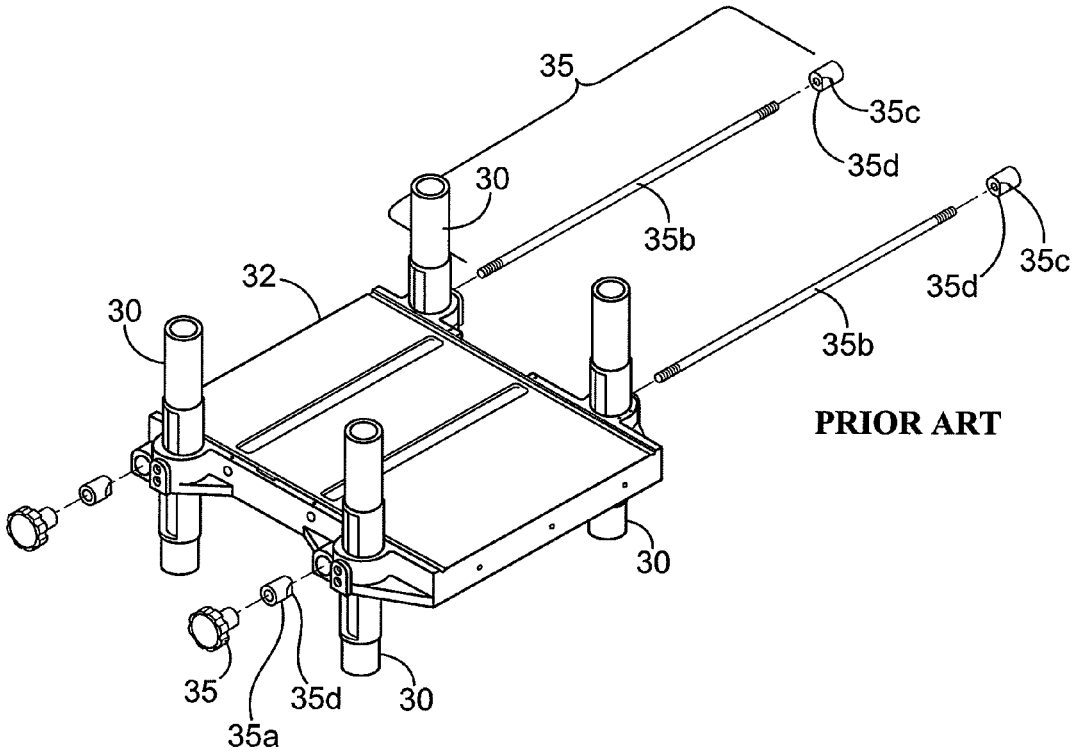
FIG. 5 is a partially exploded perspective view of a planer table assembly of the prior art.
Figure 6A:
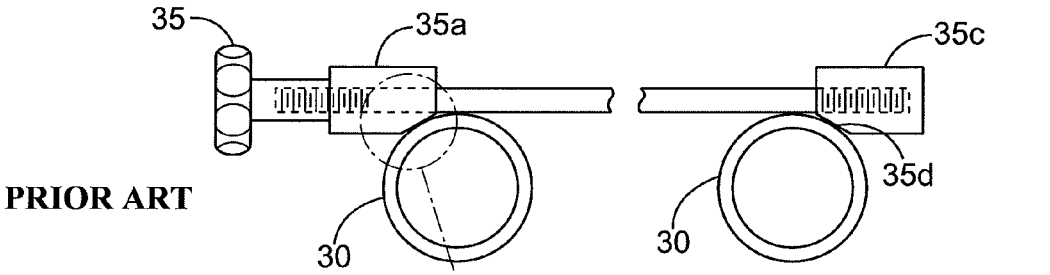
FIG. 6*a* is a plan view of the locking mechanism's relationship to the columns of a device made in accordance with the prior art, as shown in FIG. 5.
Figure 6B:
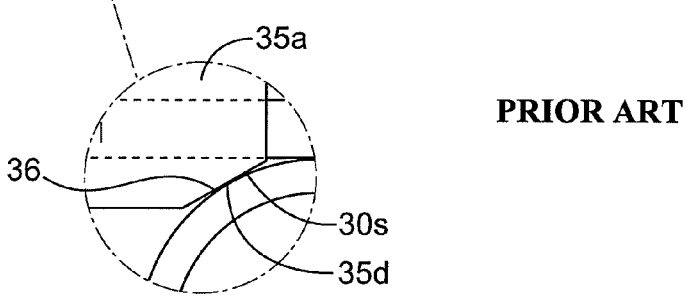
FIG. 6*b* is an enlarged partial plan view of the interface between the locking mechanism and the columns, of a device made in accordance with the prior art, as shown in FIG. 5.

The prior art, shown in FIG. 4, generally uses cylindrical columns 30 threaded into a cutterhead casting 32, through circular cross-section openings 32*c*. A locking means 34, comprising a knob 34*a* and a rod 34*b*, are provided. As is known by persons having ordinary skill in the art, in use, locking means 34 provides pressure, tangentially, on the surface of columns 30 to lock casting 32 in place. Typically, however, the use of cylinders and means to tangentially apply pressure against a cylinder causes a tenuous connection that can be easily overcome, particularly after a number of cycles of use and release which cause wear. FIGS. 5 and 6 (a and b) show a second embodiment of locking means of the prior art. In this second embodiment, in addition to a locking means 35, comprising a rod 35*b* and a knob, the additional elements of internally threaded locking collars 35*a* and 35*c* are provided. Locking collars 35*a, c* include a detent or catch 35*d*, as best shown in FIG. 6*b* that provides a slightly greater surface area for a better hold against a column 30. However, as shown in inset FIG. 6*b*, the actual point of contact 36 between detent 35*d* and column surface 30*s* is a tangential point 36. As the device is used, and the casting is locked and unlocked against columns 30, point 36 is ultimately worn away, causing a looser fit that eventually will fail, allowing slippage of the relative position of the casting 32 and columns 30. Eventually, columns 30 and locking means 35 must be replaced, usually at considerable expense and time.

Figure 7:
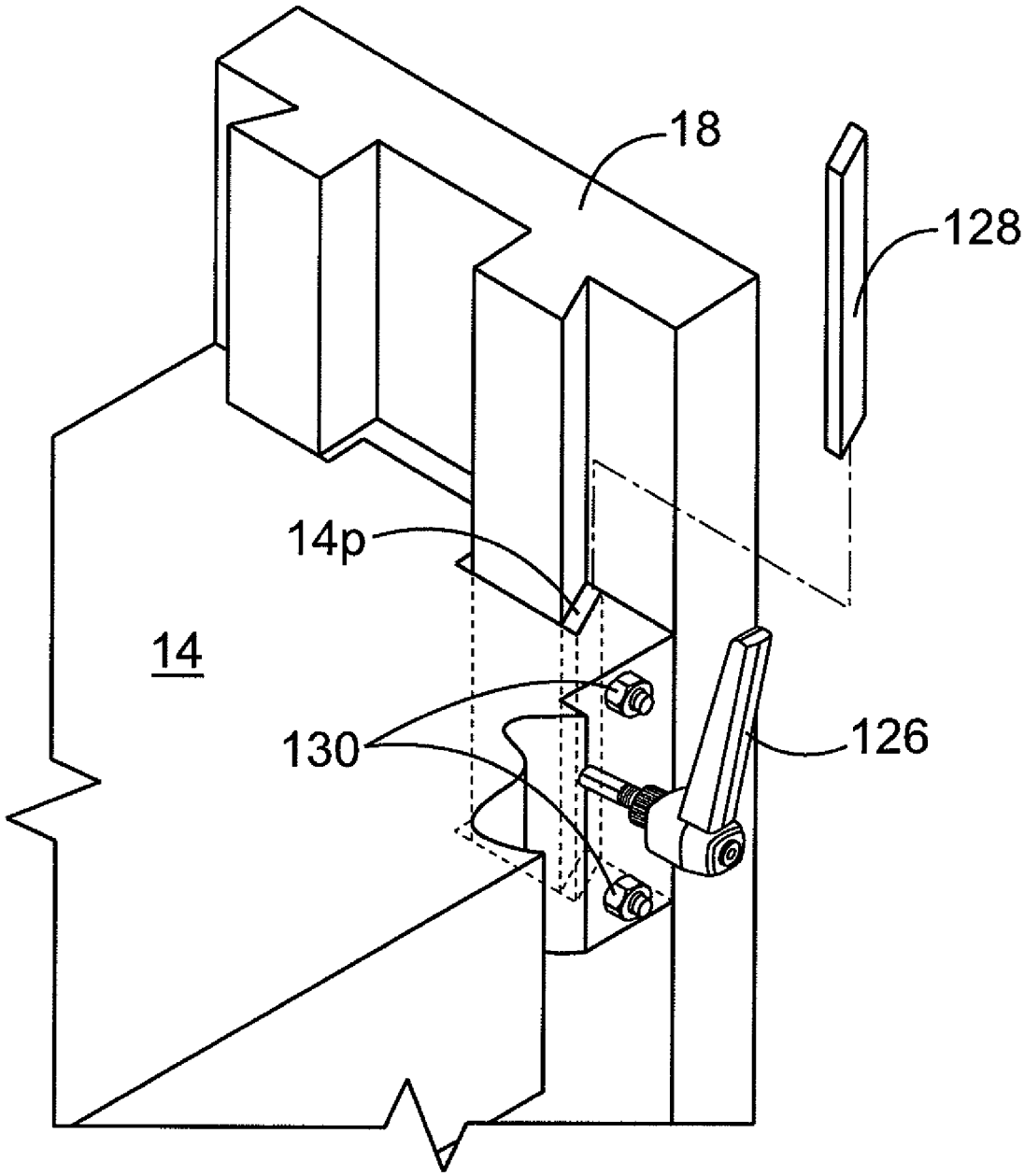
FIG. 7 is an exploded perspective view of the dovetail system of a device made in accordance with the teachings of the present invention.

Referring to FIG. 7, a further embodiment of the locking means of the present invention is shown. In the present embodiment, a casting table 14 and dovetail wall 18, as previously described are shown are included. In this new embodiment, the gib 128 is held in a pocket 14*p* in table 14 by fasteners 130; locking means 126 having a rod 126*r* and knob 126*b* are include, similarly to the previous embodiment. In the present embodiment, should any slippage occur after use of the device, the fasteners 130 can be tightened against wall 18 to eliminate slippage. Further, with respect to the present embodiment, it can be seen that a screw 29 is included adjacent to gib 28 when gib 28 is in place in casting 14. In an additional refinement to the present embodiment, gib 28 can include a cut away or detent 28*a* (as shown in a similar embodiment in FIG. 10*a* at 128*a*). As will be described in greater detail, with regard to FIGS. 10, 10*a* and 10*b*, detent 28*a* is configured to be used by screw 29 to provide a downward and lateral motion against gib 28, as screw 29 is tightened, to assist in creating an adequate contact between casting 14, gib 28 and wall 18, particularly after some wear between the connecting surfaces. A further refinement of the present embodiment is shown in FIGS. 11 and 11*a*, wherein fasteners 130 are shown in greater detail with respect to gib 128; and cause an increase in the pressures bearing on the various elements of the design as shown.

Figure 10:
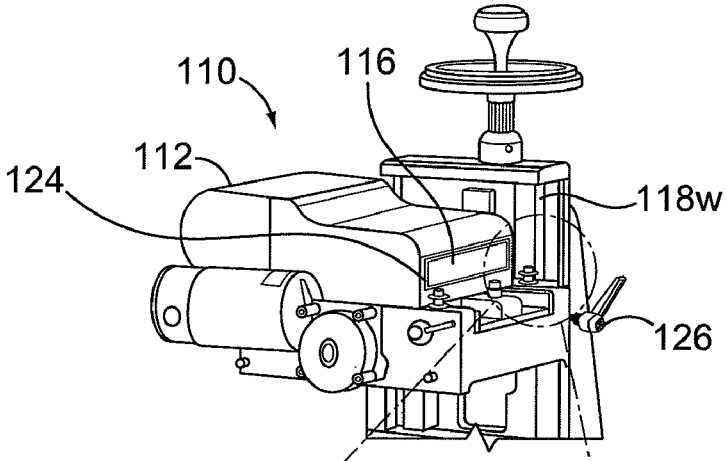
FIG. 10 is a perspective view of a further embodiment of a device made in accordance with the teachings of the present invention, with emphasis on the dovetail system of the present invention.
Figure 10A:
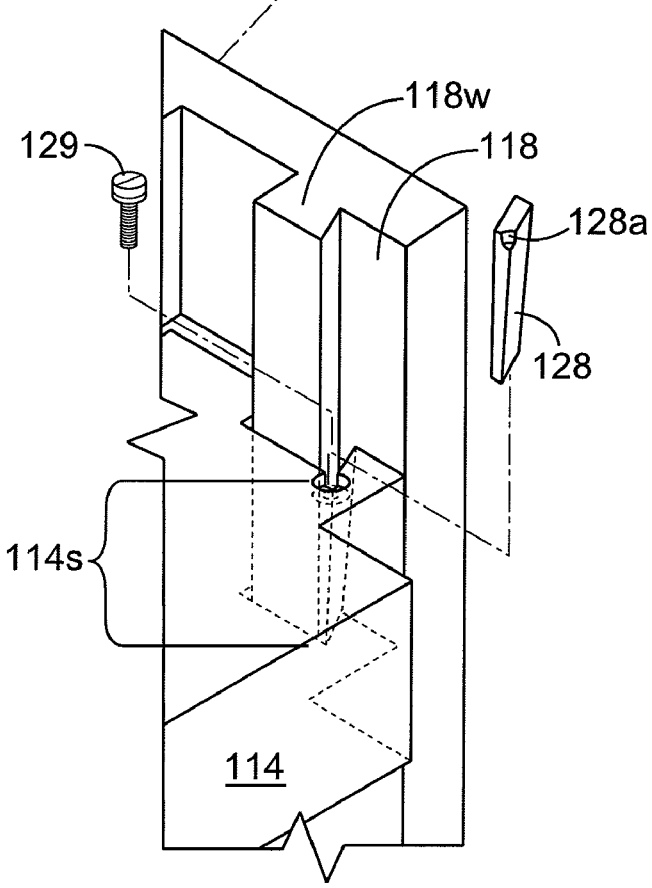
FIG. 10*a* is an exploded perspective view showing elements of the locking system of the device of FIG. 10 window C.
Figure 10B:
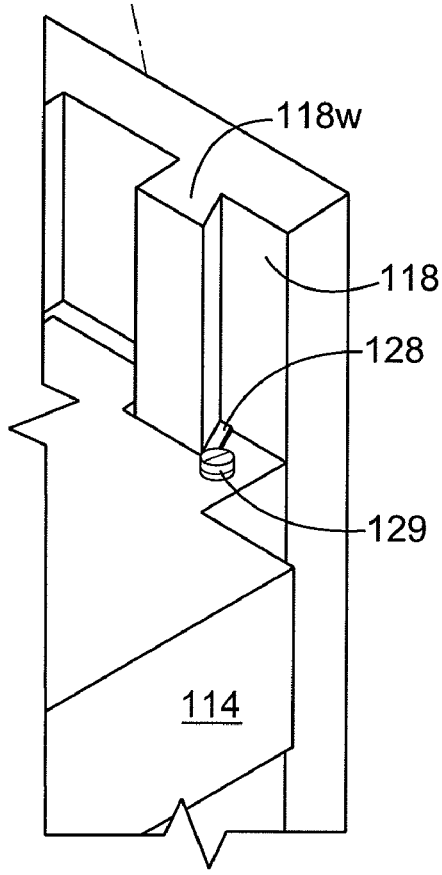
FIG. 10*b* is a perspective view, enlarged for detail, of the elements shown in FIG. 10*a* in a first operative position.
Figure 11:
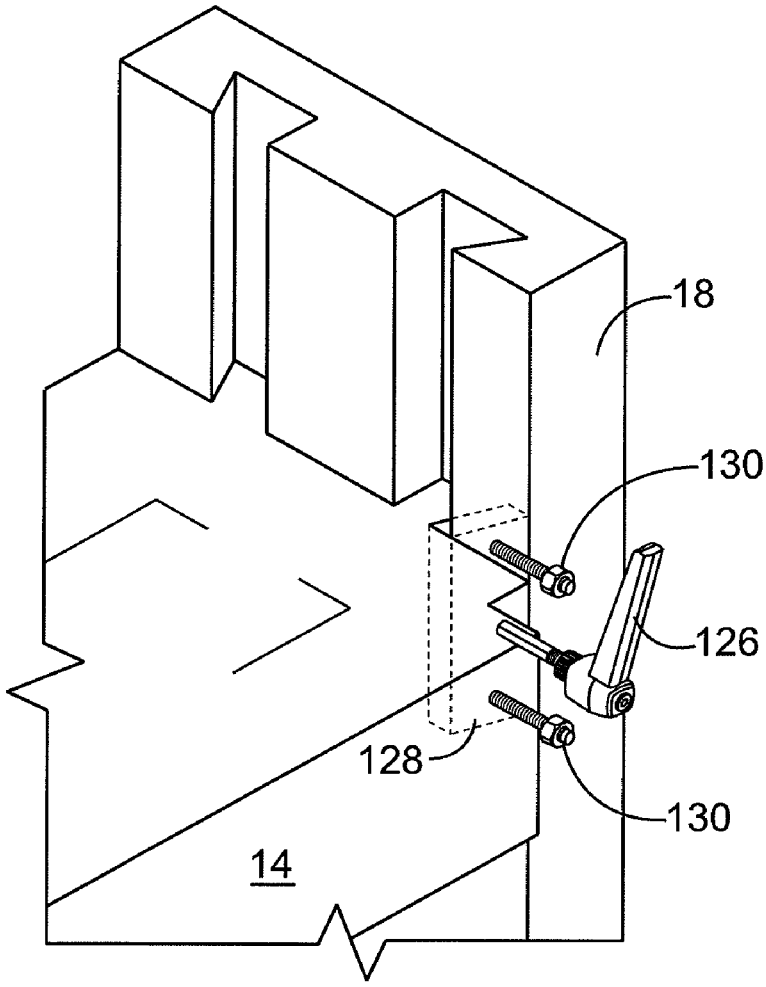
FIG. 11 is a perspective view, partially broken away, of a support structure of a device made in accordance with the teachings of the present invention.
Figure 11A:
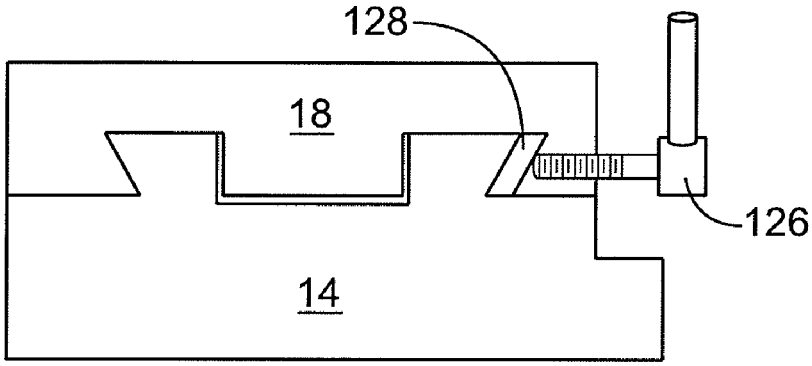

In FIG. 10 a machine, a planar/moulder device 110, similar to that shown in FIG. 1 is provided with a further embodiment of the locking system of the present invention. Elements of device 110 are numbered similarly to those of device 10, for ease of understanding; therefore, device 110 includes an upper assembly 112, a cutterhead casting 114, cutterhead 116, dovetail wall 118, dovetail ways 118*w*, a support structure 120 and a viewing window 124. A locking means 126, comprising a rod 126*a* and knob 126*b*, and gib 128 are provided for use in locking the cutterhead casting 114 in position relative to the support structure 120. In this embodiment, the gib 128 (FIG. 10*a* and 10*b*) is created having a generally wedge shape and includes a detent 128*a* and cooperative screw 129. The wedge shape of gib 128 provides additional lateral force against both casting 114 and wall 118 as it is pressed into a pocket 114*s* in casting 114. Cooperative screw 129 is used, in association with detent 128*a*, to further increase the pressure in a downward and lateral direction so as to keep casting 114 from slipping relative to wall 118. While locking means 126 would keep casting 114 fixed to wall 118 under new conditions, gib 128 will provide the extra support to the relative positions of these parts, as the device suffers ordinary wear and tear. Further, as gib 128 wears, throughout its life, it can be easily replaced (with no disassembly of device 10 or 110) and renew the strong adhesion forces that the device has when new.

In summary therefore, the device 10, 110 of the present invention uses dovetail ways 18*w*, 118*w* as guides, machined into the surface of a cast iron rectangular shaped support structure 20, 120 and the upper assembly support 12. A tapered or straight gib 28, 128 is positioned between the support structure's dovetail 14, 114 and the upper assembly support's dovetail way 18w, 118w. The upper assembly 12, 112, i.e. the cutterhead casting 14, 114, cutterhead 16, 116, drive mechanisms, belts, pulleys and motor 22, is supported in the vertical axis by the dovetail ways 18*w*, 118*w*. The dovetail ways 18*w*, 118*w* ensure straight and accurate motion along this vertical axis. During use, the upper assembly 12, 112 can be adjusted to a desired height and the assembly can be locked in place by way of a locking mechanism 26, 126. The locking mechanism is comprised of a threaded stud 26*a*, 126*a* attached to a knob or handle 26*b*, 126*b* and when turned, the end of the threaded stud presses against a gib 28, 128.

As is shown, dovetail ways 18*w*, 118*w* have several advantages over round columns 30. First, the mating surfaces of the round columns 30 and support casting or table 32 eventually wear away due to the friction caused by adjusting their height. This causes looseness or "play" to develop in the system for which there is no adjustment. This affects the locking ability, accuracy and safe operation of the machine. It has been found that it is costly to remedy this as replacement of the round columns 30 and upper support casting or table 32 is necessary to the remedy. However, in the present invention using dovetail shaped ways as disclosed, a gib provides adjustment for wear as shown and described. Further a tapered gib 128 can be adjusted deeper into the space 114*s* between the male and female mating parts of the support structure and upper assembly support. In another embodiment, a device of the present invention can use a straight gib 28 along with adjusting screws 130, positioned along the length of the gib 28, such that as wear develops the screws 130 can be tightened to make up for wear. Either type of gib can be replaced, if needed, at a greatly reduced cost and downtime for the device, compared with the replacement of the round column system of support.

A locking mechanism, of the type used with the round column system of support of the prior art, tends to apply pressure in a very small area on the columns 30. In some devices, the clamping means 34 and column 30 have very little area of contact 30*s* (FIG. 6*b*). Consequently, the actual clamping force available to secure the upper assembly or table is small. With the dovetail system of the present invention, the locking pressure is distributed along the dovetail ways 18*w*, 118*w* through the gib 28, 128 when clamping force is applied with the locking mechanism 26, 126. The clamping pressure is further distributed through the support structure and upper assembly support to the opposite side of the dovetail away from the locking means, thereby providing much more holding power by providing far more area of contact. This element of the present invention advantageously creates greater clamping force than the round column system of the prior art. Prior art systems, due to less available clamping forces, have been known to allow the cutterhead to slip and move, relative to the support structure, during a cutting operation; spoiling the work and may cause an unsafe condition.

In embodiments of the present invention, along with the accuracy provided by the movement and locking of the present device, a clear polycarbonate or Plexiglas® window 24, located in the cutterhead cover is included. Advantageously, this provides a means by which the user can simplify setting up the guide fences for molding work. As is known by persons having ordinary skill in the art, guide fences force the workpiece through the critical portion of the molding knives. Having a window in the cutterhead cover will facilitate the alignment of the guide fences by allowing the operator to directly view their placement, thus accelerating set-up and improving quality of the finished product. Further, a window in this location provides the operator a view to see the chip flow as the workpiece is being milled. Persons having skill in the art will understand that chips that are not removed immediately from the cutterhead area can be drawn back into the path of the workpiece. These chips can then be inadvertently recut causing the dulling of the knives. Further, the chips can be inadvertently crushed into the workpiece, spoiling the finish. When the operator sees poor chip flow through the provided window he can make adjustments to his dust collection system, depth of cut, feed rate or choose lumber with less moisture content, improving production and quality.

Although an illustrative embodiment of the invention has been shown and described, it is to be understood that various modifications and substitutions may be made by those skilled in the art without departing from the novel spirit and scope of the invention.

What is claimed is:

1. A device for planing and moulding materials comprising:

a cutterhead;

a means for raising and lowering the cutterhead relative to a work surface;

at least one column, having at least one rectilinear wall, the cutterhead being kept in alignment as the cutterhead is raised and lowered on the column;

the cutterhead further comprising a lock and at least one opening for cooperative engagement with the at least one column the lock comprising a knob and rod, the distal end of the rod emerging from the at least one opening in the cutterhead in proximity to the rectilinear wall of the at least one column, such that when the cutterhead is placed at a desired position and the lock is employed, the distal end of the rod engages the rectilinear wall, fixing the cutterhead at the desired position.

2. The device of claim 1, wherein the cutterhead includes a platform, and the at least one opening for cooperative engagement with the at least one column is located on the platform.

3. The device of claim 2, wherein the at least one column has a dovetail shaped cross-section.

4. The device of claim 2, wherein the at least one opening located on the platform is enlarged and includes a gib, placed in the at least one opening for compression, by the lock, against the rectilinear wall of a column.

5. The device of claim 1, wherein the at least one column is two columns.

6. The device of claim 4, wherein the gib is wedge shaped.

7. The device of claim 4, including one or more fasteners attaching the gib to the cutterhead so as to allow the gib to be adjusted relative to the cutterhead to overcome wear on the column.

8. The device of claim 1, wherein the cutterhead further comprises a cutting knife and a transparent covering placed so as to peimit viewing of a location of the cutting knife relative to material to be shaped.

9. A device for planing and moulding materials comprising:

a cutterhead;

a means for raising and lowering the cutterhead relative to a work surface;

a first and second column each having a dovetail shaped cross-section and at least one rectilinear wall, the cutterhead being kept in alignment as the cutterhead is raised and lowered on the first and second columns;

the cutterhead further comprising a lock and first and second openings for cooperative engagement with the first and second columns, the lock comprising a knob and rod, the distal end of the rod emerging from the first opening in the cutterhead in proximity to the rectilinear wall of the first column, such that when the cutterhead is placed at a desired position and the lock is employed, the distal end of the rod engages the rectilinear wall, fixing the cutterhead at the desired position.

10. The device of claim 9, wherein the means for raising and lowering the cutterhead includes an elevating screw assembly.

11. The device of claim 9, wherein the first opening defined in the cutterhead is enlarged and includes a gib, placed in the first opening, for compression by the lock, against the rectilinear wall of a column.

12. The device of claim 11, wherein the gib is wedge shaped and locks the cutterhead to the columns when compressed by the lock.

13. The device of claim 9, including a platform onto which the cutterhead and columns are affixed, the cutterhead being adjustably attached to the platform by the columns.

14. The device of claim 9, wherein the cutterhead further comprises a cutting knife and a transparent covering placed so as to permit viewing of a location of the cutting knife relative to material to be planed or moulded.

15. The device of claim 11, including one or more fasteners to further press the gib against the column so as to overcome wear on the column.

16. A method of accurately planing or moulding materials comprising the steps of:

providing a stand and a cutterhead, the cutterhead configured to either plane or mould materials;

providing at least one column attached to the stand, the at least one column having at least one rectilinear wall that acts as a rail onto which the cutterhead is aligned as the cutterhead is raised and lowered;

providing a gib disposed between the cutter head and the column, providing a lock; and engaging the lock such that the gib is pressed against a rectilinear wall of the column, fixing the cutterhead at a desired position on the column in planing or moulding contact with the material to be planed or moulded.

17. The method of accurately planing or moulding materials of claim 16, wherein the lock comprises a rod and threaded knob, the rod and knob being joined together, the knob being in threaded engagement with the cutterhead and the rod being in contact with the gib, at the distal end of the rod, and including the step of threading the knob into the cutterhead such that the rod presses the gib against the column.

* * * * *